US005392961A

United States Patent [19]

Starrett

[11] Patent Number: 5,392,961

[45] Date of Patent: Feb. 28, 1995

[54] SAFETY TAB DEVICE AND THE COMBINATION WITH AN AEROSOL CONTAINER SYSTEM

[75] Inventor: Paul D. Starrett, Jaffrey, N.H.

[73] Assignee: Casco International, Inc., Fitzwillaim, N.H.

[21] Appl. No.: 80,214

[22] Filed: Jun. 18, 1993

[51] Int. Cl.[6] ..... B67D 5/33

[52] U.S. Cl. ..... 222/153; 222/182; 222/402.11

[58] Field of Search ..... 222/153, 183, 384, 402.11, 222/575, 182; 137/382, 383; 251/90; 220/725, 728; 239/288.5

[56] References Cited

U.S. PATENT DOCUMENTS

| | | | |
|---|---|---|---|
| D. 296,663 | 7/1958 | Rudick et al. | D9/448 X |
| D. 325,357 | 4/1992 | Worthington | D9/300 X |
| 3,184,115 | 5/1965 | Meshberg | D9/300 X |
| 3,334,627 | 8/1967 | Gorman | D9/448 X |
| 3,837,537 | 9/1974 | Baldwin | 222/402.11 |
| 4,353,483 | 10/1982 | Pehr | 222/153 |
| 4,442,955 | 4/1984 | Bush | 222/153 |
| 5,170,782 | 12/1992 | Kocinski | 239/338 X |
| 5,238,141 | 8/1993 | Callegari et al. | 220/725 |

FOREIGN PATENT DOCUMENTS

| | | | |
|---|---|---|---|
| 2630352 | 1/1978 | Germany | 222/402.11 |
| 464443 | 3/1952 | Italy | 220/728 |

OTHER PUBLICATIONS

Cas-Expandable Police Batons and CAS-OC, Casco International, Inc. Dec. 1992.

Aerosol Age; Jul. 1985; p. 19; Back Row on Left.

*Primary Examiner*—Andres Kashnikow

*Assistant Examiner*—Philippe Derakshani

*Attorney, Agent, or Firm*—Donald Brown

[57] ABSTRACT

A safety tab device coupled to an aerosol container by a connecting member, a flexible member coupled to the connecting member and a flip tab coupled to the flexible member and which can be locked to the aerosol container to make it difficult to spray chemicals from the container without unlocking the tab.

1 Claim, 3 Drawing Sheets

SAFETY TAB DEVICE AND THE COMBINATION WITH AN AEROSOL CONTAINER SYSTEM

BACKGROUND OF THE INVENTION

This invention is directed to a safety tab device for use with a spray container system, e.g., an aerosol spray container for spraying chemicals used in law enforcement by police. Such chemicals such as an oleoresin-capsicum mixture are conventionally used to cause eye and respiratory system irritation in order to subdue suspects.

BRIEF DESCRIPTION OF THE INVENTION

This invention is directed to a safety tab device which can be coupled to an aerosol container system by a connecting member, a flexible member coupled to said connecting member and a flip tab coupled thereto and which can be locked to the aerosol container to make it difficult to spray chemicals from the container without unlocking the flip tab.

In the preferred embodiment of the invention, the connecting member comprises a collar which fits over a portion of a flared nozzle guard and in which the flip tab is provided with projections positionable in holes of the aerosol container above the actuator of the aerosol container to lock it in place. When the user wishes to depress the actuator, the user can flip up the tab using a thumb so that the users thumb can be placed on the aerosol actuator to depress same to cause chemicals to be sprayed. With the proper use of the safety tab system, accidental release of spray is avoided and the tab can be easily unlocked by the user when necessary simply by use of the thumb.

DETAILED DESCRIPTION OF THE INVENTION

Figure 1:
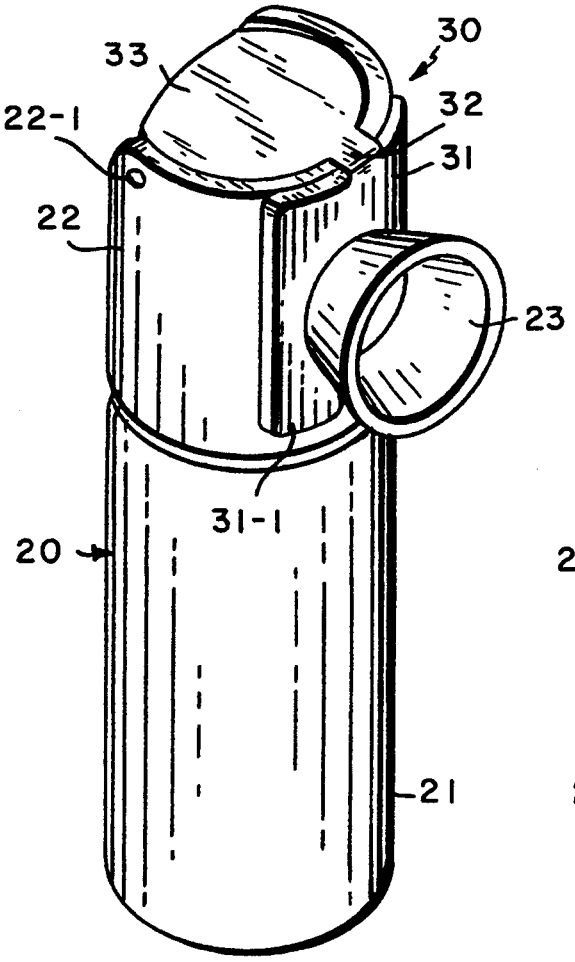
FIG. 1 is a front perspective of the aerosol container with safety tab system with the flip tab in the locked position.
Figure 2:
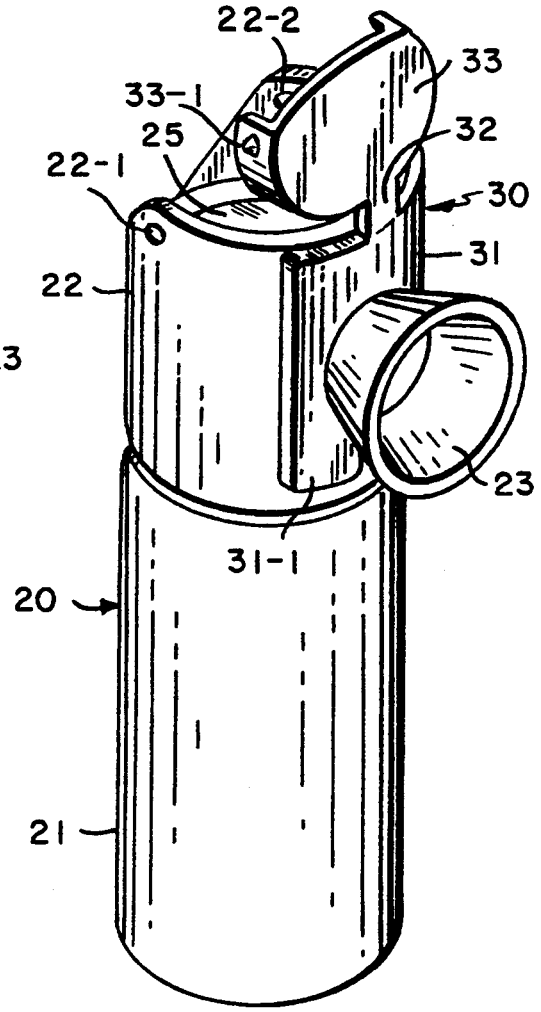
FIG. 2 is the same view as FIG. 1 except that the flip tab is in the unlocked position.
Figure 3:
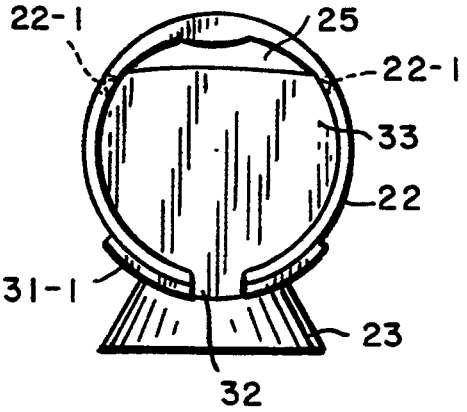
FIG. 3 is a top view of FIG. 1.
Figure 4:
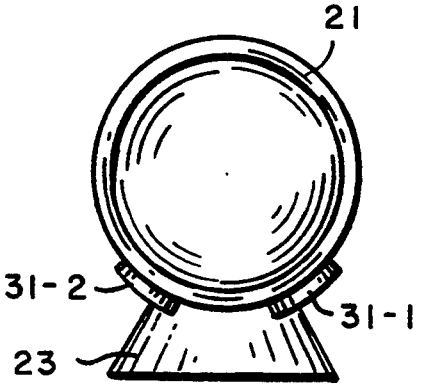
FIG. 4 is a bottom view of FIG. 1.
Figure 5:
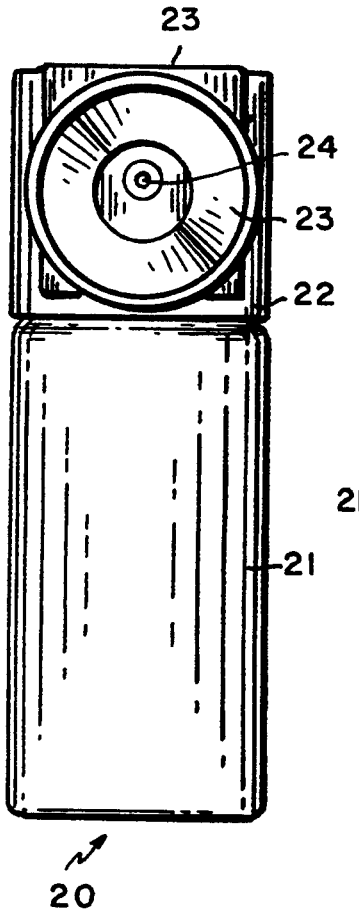
FIG. 5 is a front elevation of FIG. 1.
Figure 6:
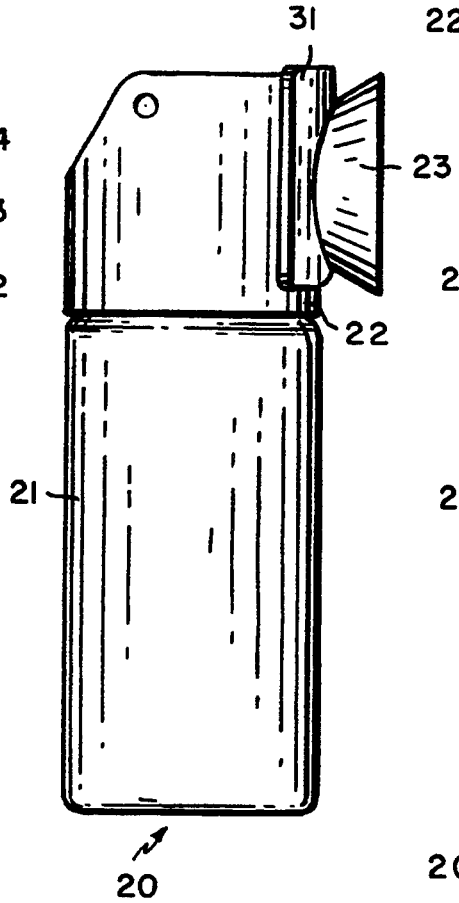
FIG. 6 is a side elevation of FIG. 1.
Figure 7:
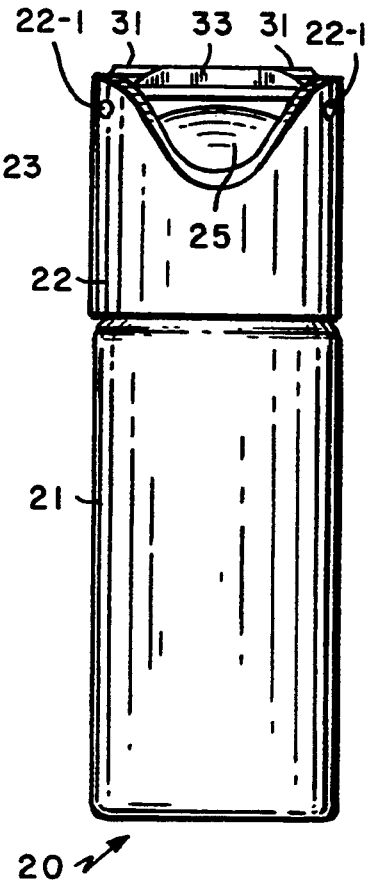
FIG. 7 is a rear elevation of FIG. 1.
Figure 8:
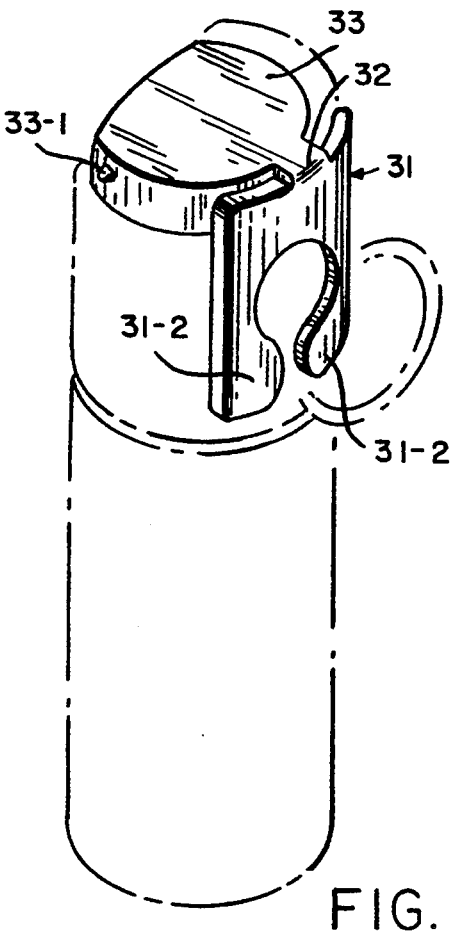
FIG. 8 is a front perspective view of the safety tab system with the tab in a horizontal position.
Figure 9:
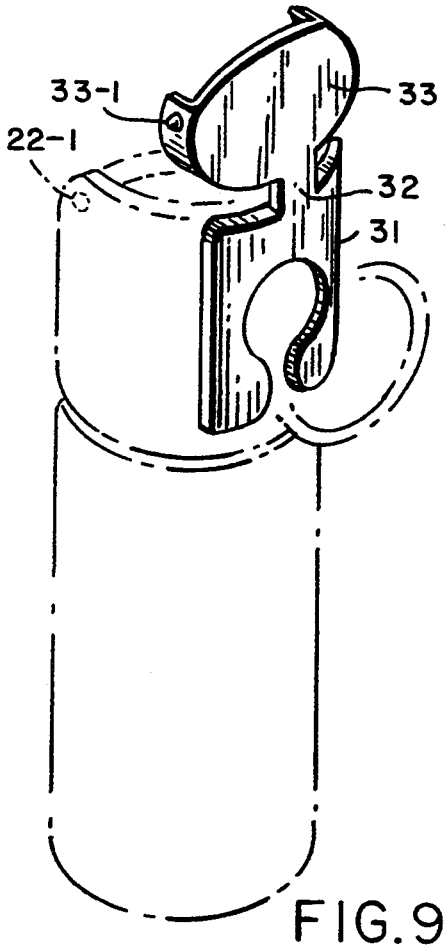
FIG. 9 is a front perspective view of the safety tab system with the flip tab in a vertical position.
Figure 10:
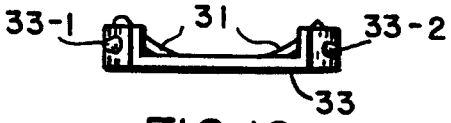
FIG. 10 is a top view of safety tab system looking down on FIG. 9.
Figure 14:
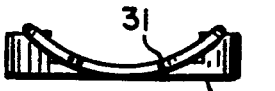
FIG. 14 is a bottom view of the safety tab system of FIG. 13.
Figure 11:
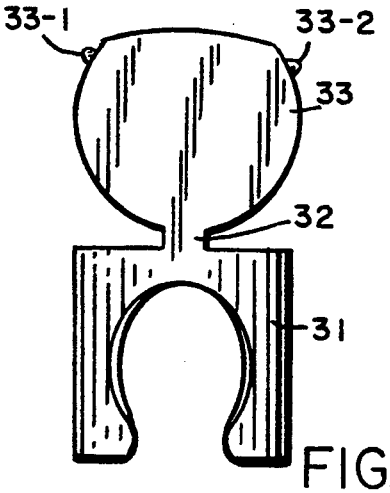
FIG. 11 is a front elevation of the safety tab system in FIG. 9.
Figure 12:
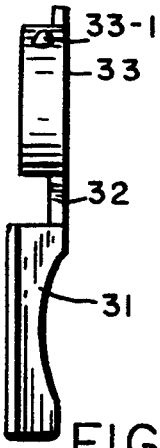
FIG. 12 is a side elevation of the safety tab system of FIG. 11.
Figure 13:
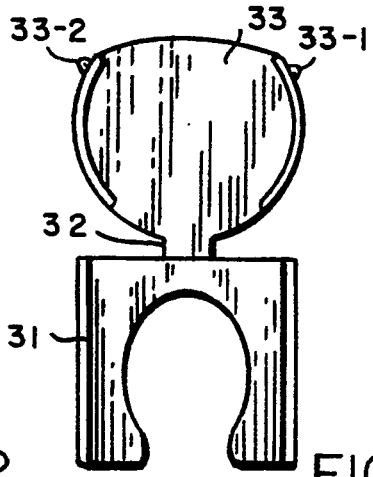
FIG. 13 is a rear elevation of the safety tab system of FIG. 11.

Reference should be had to FIGS. 1 to 13 for a detailed description of the invention.

At 20 there is shown the container system which includes a canister 21, a cap 22, a nozzle 24, a flared nozzle guard 23 extending from the cap to direct the spray from the nozzle 24. At 25 there is provided a conventional actuator which is depressed to cause a spray of the substance from the container. In the preferred embodiment, a spray containing 5.5% oleoresin-capsicum. However, the exact nature of the ingredients to be sprayed forms no part of this invention.

At 30 there is shown a safety tab unit preferably made of plastic e.g. polyethylene or polypropylene which has a collar portion 31 which is used to couple it to the cap by fitting over the nozzle guard 23 as shown. At 32, a flexible hinge is provided so that the flip tab 33 coupled thereto (see FIG. 1) may be positioned to substantially block (i.e. make it difficult) to depress the actuator 25 to cause the material in the canister to be sprayed therefrom. When the tab is in this position, projections 33-1 and 33-2 are located in cap openings 22-1 and 22-2 (see FIG. 2) which extend through the cap.

In order to easily depress the actuator 25, the user can easily use their thumb (nail side) to flip up the tab 33 (see FIG. 2) to permit the actuator to be depressed.

It should be understood that the member 33 may be affixed e.g. by glue to the cap or if desired the tab and hinge can be made integral with the cap, however the present construction permits the user to dispense with the safety tab unit 30 if desired.

It should also be apparent that the joining means used to couple the tab to the cap can take many different designs e.g. with the projections on the cap 22 and the openings in the flip top 33 sides.

I claim:

1. An aerosol container system comprising a canister, a cap on said canister, a canister actuator, a flared nozzle guard coupled to said cap, a flip tab and means for locking said flip tab to said cap in position to inhibit said actuator from being depressed, said flip tab coupled to a flexible connecting means which is coupled to a collar means an said collar means positioned about a portion of said flared nozzle guard.

* * * * *